US009569990B2

(12) United States Patent
Ha

(10) Patent No.: US 9,569,990 B2
(45) Date of Patent: Feb. 14, 2017

(54) SYSTEM AND METHOD FOR CONTROLLING SMART LED DISPLAY BOARD CAPABLE OF COMPENSATING FOR LUMINANCE OF LED

(71) Applicant: DONG BANG DATA TECHNOLOGY CO., LTD., Seoul (KR)

(72) Inventor: Young Jea Ha, Anyang-si (KR)

(73) Assignee: DONG BANG DATA TECHNOLOGY CO., LTD., Seoul (KR)

( * ) Notice: Subject to any disclaimer, the term of this patent is extended or adjusted under 35 U.S.C. 154(b) by 399 days.

(21) Appl. No.: 14/190,913

(22) Filed: Feb. 26, 2014

(65) Prior Publication Data

US 2014/0240375 A1 Aug. 28, 2014

(30) Foreign Application Priority Data

Feb. 28, 2013 (KR) ..... 10-2013-0022228
Apr. 17, 2013 (KR) ..... 10-2013-0042025

(51) Int. Cl.
*G09G 3/32* (2016.01)
*G09G 3/00* (2006.01)

(52) U.S. Cl.
CPC ..... *G09G 3/006* (2013.01); *G09G 3/32* (2013.01); *G09G 2320/0233* (2013.01); *G09G 2320/0693* (2013.01)

(58) Field of Classification Search
CPC ..... G09G 2320/0233; G09G 2320/0693; G09G 2320/0295; G09G 2320/043; G09G 2320/045
See application file for complete search history.

(56) References Cited

U.S. PATENT DOCUMENTS

2005/0134525 A1* 6/2005 Tanghe ..... G06F 3/1446 345/1.1
2008/0055210 A1* 3/2008 Cok ..... G09G 3/006 345/77
2008/0170004 A1* 7/2008 Jung ..... G09G 3/3233 345/76
2011/0181500 A1* 7/2011 Liao ..... G09G 3/3208 345/76

FOREIGN PATENT DOCUMENTS

KR 101006050 12/2010

* cited by examiner

*Primary Examiner* — Amr Awad
*Assistant Examiner* — Stephen Bray
(74) *Attorney, Agent, or Firm* — LEX IP MEISTER, PLLC

(57) ABSTRACT

A system for controlling a smart LED display board capable of compensating for luminance of an LED includes a luminance measurement unit which creates first luminance measurement data obtained by digitizing measured luminance of each LED, an image data input unit which receives first input data about each LED, a comparison unit which selects at least one first LED having a luminance value greater than a preset reference value, and creates a compensation power value compensating for the luminance value of the selected first LED; an image data compensation unit which receives the first input data and the compensation power value and creates second input data in which a power value that is contained in the first input data transmitted to the first LED is changed into the compensation power value; and a drive unit which transmits the second input data to the first LED.

2 Claims, 11 Drawing Sheets

| bit value | original gray value | gray compensation value 1 | gray compensation value 2 |
|---|---|---|---|
| 0000 0000 | 0 | 0 | 0 |
| 0000 0001 | 1 | 0.7 | 0.4 |
| - - - - | - - - - | - - - - | - - - - |
| 1111 1110 | 254 | 239 | 219 |
| 1111 1111 | 255 | 240 | 220 |

gray scale compensation table

SYSTEM AND METHOD FOR CONTROLLING SMART LED DISPLAY BOARD CAPABLE OF COMPENSATING FOR LUMINANCE OF LED

BACKGROUND OF THE INVENTION

1. Field of the Invention

The present invention relates generally to systems and methods for controlling smart LED display boards capable of compensating for luminance of LEDs and, more particularly, to a system and method for controlling a smart LED display board capable of compensating for luminance of an LED in which after an LED that has malfunctioned is individually replaced with a new one in a display board using LEDs, the luminance of the replaced new LED can be individually compensated for so that it can correspond to the luminance of the surrounding existing LEDs of the display board.

2. Description of the Related Art

Generally, in display boards using LEDs, when an LED that has malfunctioned is individually replaced with a new one, luminance of the replaced new LED is higher than that of existing surrounding LEDs. In this case, only a portion in which the replaced new LED is disposed appears brighter, and portions in which the existing LEDs are disposed appear dim in comparison.

With regard to this, a system for detecting luminance of an LED backlight for liquid crystal displays was proposed in Korean Patent Registration No. 0898521. However, this conventional technique can only detect luminance of LEDs but cannot compensate for luminance of an LED that differs from the other LEDs.

SUMMARY OF THE INVENTION

Accordingly, the present invention has been made keeping in mind the above problems occurring in the prior art, and an object of the present invention is to provide a system and method for controlling a smart LED display board capable of compensating for luminance of an LED in which when an LED that has malfunctioned is individually replaced with a new one in a display board using LEDs, the luminance of the replaced new LED can be individually compensated for so that it can correspond to the luminance of the surrounding existing LEDs of the display board.

Another object of the present invention is to provide a system and method for controlling a smart LED display board capable of compensating for luminance of an LED in which when an LED dot that has malfunctioned is individually replaced with a new one, the luminance of the replaced new LED dot can be individually compensated for so that it can correspond to the luminance of the surrounding existing LED dots.

In order to accomplish the above object, in an aspect, the present invention provides a system for controlling a smart LED display board capable of compensating for luminance of an LED, including: a luminance measurement unit measuring luminance of each of LEDs of the display board and creating first luminance measurement data obtained by digitizing the measured luminance of each of the LEDs; an image data input unit receiving first input data about a lighting-on time, a lighting-off time, a power value supplied when lighting on and a luminance value when lighting on with regard to each of the LEDs; a comparison unit receiving the first luminance measurement data from the luminance measuring unit and selecting, based on the first luminance measurement data, at least one first LED having a luminance value greater than a preset reference luminance value among the LEDs that have been digitized in luminance values, and creating a compensation power value compensating for the luminance value of the selected first LED so that the luminance value of the first LED corresponds to an average value of luminance values of second LEDs that are remaining LEDs other than the first LED; an image data compensation unit receiving the first input data from the image data input unit and receiving the compensation power value from the comparison unit, and creating second input data in which a power value to be supplied when lighting on that is contained in the first input data transmitted to the first LED is changed into the compensation power value; and a drive unit receiving the second input data from the image data compensation unit and transmitting the second input data to the first LED, the luminance measurement unit measuring luminance of each of dots of the LEDs and further creating second luminance measurement data obtained by digitizing the measured luminance of each of the LED dots, the image data input unit further receiving third input data about a lighting-on time, a lighting-off time, a power value supplied when lighting on and a luminance value when lighting on with regard to each of the LED dots, the comparison unit receiving the second luminance measurement data from the luminance measuring unit and selecting, from the second luminance measurement data, at least one first LED dot having a luminance value greater than a preset reference luminance value among the LED dots that have been digitized in luminance values, and further creating a compensation power value compensating for the luminance value of the selected first LED dot so that the luminance value of the first LED dot corresponds to an average value of luminance values of second LED dots that are remaining LED dots other than the first LED dot, the image data compensation unit receiving the third input data from the image data input unit and receiving the compensation power value from the comparison unit, and further creating fourth input data in which a power value supplied when lighting on that is contained in the third input data transmitted to the first LED dot is changed into the compensation power value, and the drive unit receiving the fourth input data transmitted from the image data compensation unit and further transmitting the fourth input data to the first LED dot.

In another aspect, the present invention provides a method for controlling a smart LED display board capable of compensating for luminance of an LED, including: (a) inputting first input data about a lighting-on time, a lighting-off time, a power value supplied when lighting on and a luminance value when lighting on with regard to each of LEDs of the display board to an image data input unit; (b) measuring, by a luminance measurement unit, luminance of each of LEDs of the display board and creating first luminance measurement data obtained by digitizing the measured luminance of each of the LEDs; (C) receiving, by a comparison unit, the first luminance measurement data from the luminance measuring unit and selecting, based on the first luminance measurement data, at least one first LED having a luminance value greater than a preset reference luminance value among the LEDs that have been digitized in luminance values, and creating a compensation power value compensating for the luminance value of the selected first LED so that the luminance value of the first LED corresponds to an average value of luminance values of second LEDs that are remaining LEDs other than the first LED; (d) receiving, by an image data compensation unit, the first input data from the image data input unit and receiving the compensation power value from the comparison unit, and creating second input data in which a power value to be supplied when lighting on that is contained in the first input data transmitted to the first LED is changed into the compensation power value; and (e) receiving, by a drive unit, the second input data from the image data compensation unit and transmitting the second input data to the first LED, (a) inputting comprising inputting third input data about a lighting-on time, a lighting-off time, a power value supplied when lighting on and a luminance value when lighting on with regard to each of dots of the LEDs to the image data input unit, (b) measuring comprising measuring, by the luminance measurement unit, luminance of each of the LED dots and creating second luminance measurement data obtained by digitizing the measured luminance of each of the LED dots, (C) receiving comprising receiving, by the comparison unit, the second luminance measurement data from the luminance measuring unit and selecting, from the second luminance measurement data, at least one first LED dot having a luminance value greater than a preset reference luminance value among the LED dots that have been digitized in luminance values, and creating a compensation power value compensating for the luminance value of the selected first LED dot so that the luminance value of the first LED dot corresponds to an average value of luminance values of second LED dots that are remaining LED dots other than the first LED dot, (d) receiving data comprising receiving, by the image data compensation unit, the third input data from the image data input unit and receiving the compensation power value from the comparison unit, and creating fourth input data in which a power value supplied when lighting on that is contained in the third input data transmitted to the first LED dot is changed into the compensation power value, and (e) receiving comprising receiving, by the drive unit, the fourth input data transmitted from the image data compensation unit and transmitting the fourth input data to the first LED dot.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
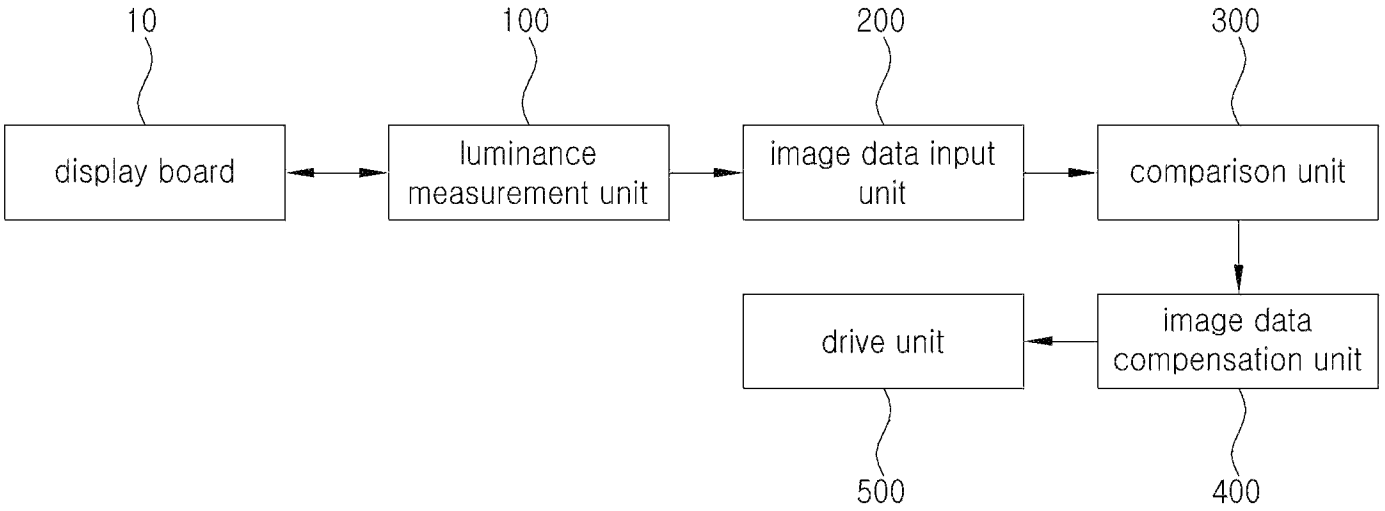
FIG. 1 is a block diagram illustrating a system for controlling a smart LED display board capable of compensating for luminance of an LED according to a preferred embodiment of the present invention.

The above and other objects, features and advantages of the present invention will be more clearly understood from the following detailed description taken in conjunction with the accompanying drawings. The present invention is not limited to the following embodiments, and various modifications are possible. The embodiments are only for illustrative purposes to enable those skilled in this art to easily understand the scope of the present invention. The scope of the present invention must be defined by the accompanying claims. The same reference numerals are used throughout the different drawings to designate the same or similar components.

Hereinafter, a system and method for controlling a smart LED display board capable of compensating for luminance of an LED according to a preferred embodiment of the present invention will be described in detail with reference to the attached drawings.

Figure 2:
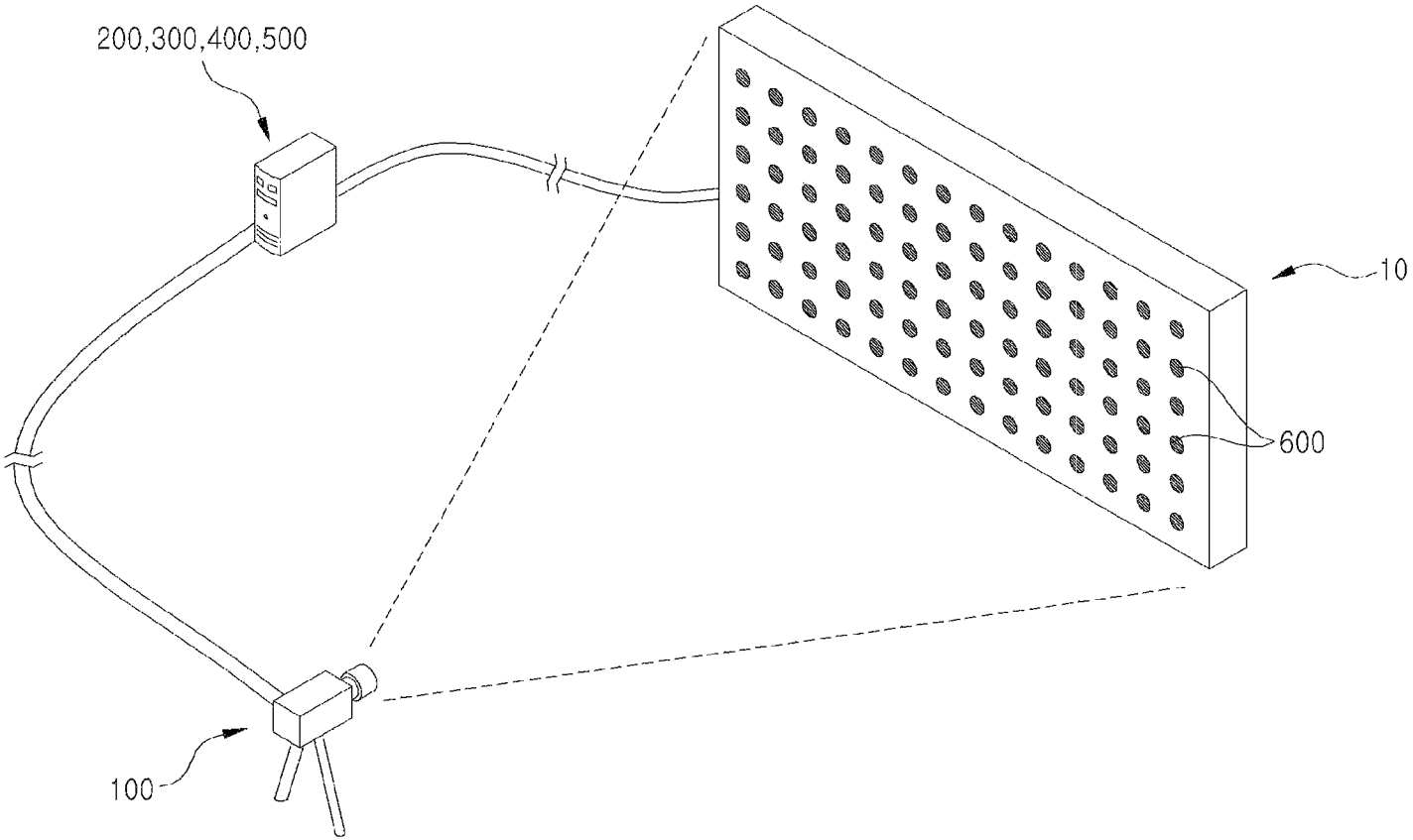
FIG. 2 is a schematic view illustrating the system for controlling the smart LED display board according to the preferred embodiment of the present invention.

As shown in FIGS. 1 and 2, the system for controlling the smart LED display board according to the preferred embodiment of the present invention includes a luminance measurement unit 100, an image data input unit 200, a comparison unit 300, an image data compensation unit 400 and a drive unit 500.

The luminance measurement unit 100 measures luminance of an LED 600 of the display board 10 and digitizes the measured luminance values of the LEDs 600, thus creating first luminance measurement data. As shown in FIG. 2, measuring luminance values of the LEDs 600, the luminance measurement unit 100 is disposed at a position spaced apart from the display board 10 by a predetermined distance.

A range within which luminance values of LEDs 600 are measured may be the entirety of the display board 10 or a specific portion of the display board 10.

Furthermore, the luminance measurement unit 100 measures the input data (color values) by levels from 0 to 255 and stores measured values as OldBrightTb and NewBrightTb.

First input data about a lighting-on time, a lighting-off time, a power value supplied when lighting on and a luminance value when lighting on with regard to each LED 600 is input to the image data input unit 200.

In the first input data that is input to the image data input unit 200, the lighting-on time and the lighting-off time of each LED 600 respectively refer to times at which the LED 600 is turned on and off to embody a blinking image.

Furthermore, in the first input data that is input to the image data input unit 200, the power value supplied to the LED 600 when the LED 600 is turned on and the luminance value when lighting is turned on respectively mean a power value supplied when the LED 600 must emit, for example, light having a luminance value of 5 when it is turned on and a corresponding luminance value.

The comparison unit 300 receives the first luminance measurement data from the luminance measurement unit 100 and creates, from the first luminance measurement data, second input data including a compensation power value which compensates for a luminance value of a first LED 610 so that the luminance value of the first LED 610 corresponds to an average value of the luminance values of second LEDs 620 other than the luminance value of the first LED 610 that is a predetermined value or more.

Figure 3:
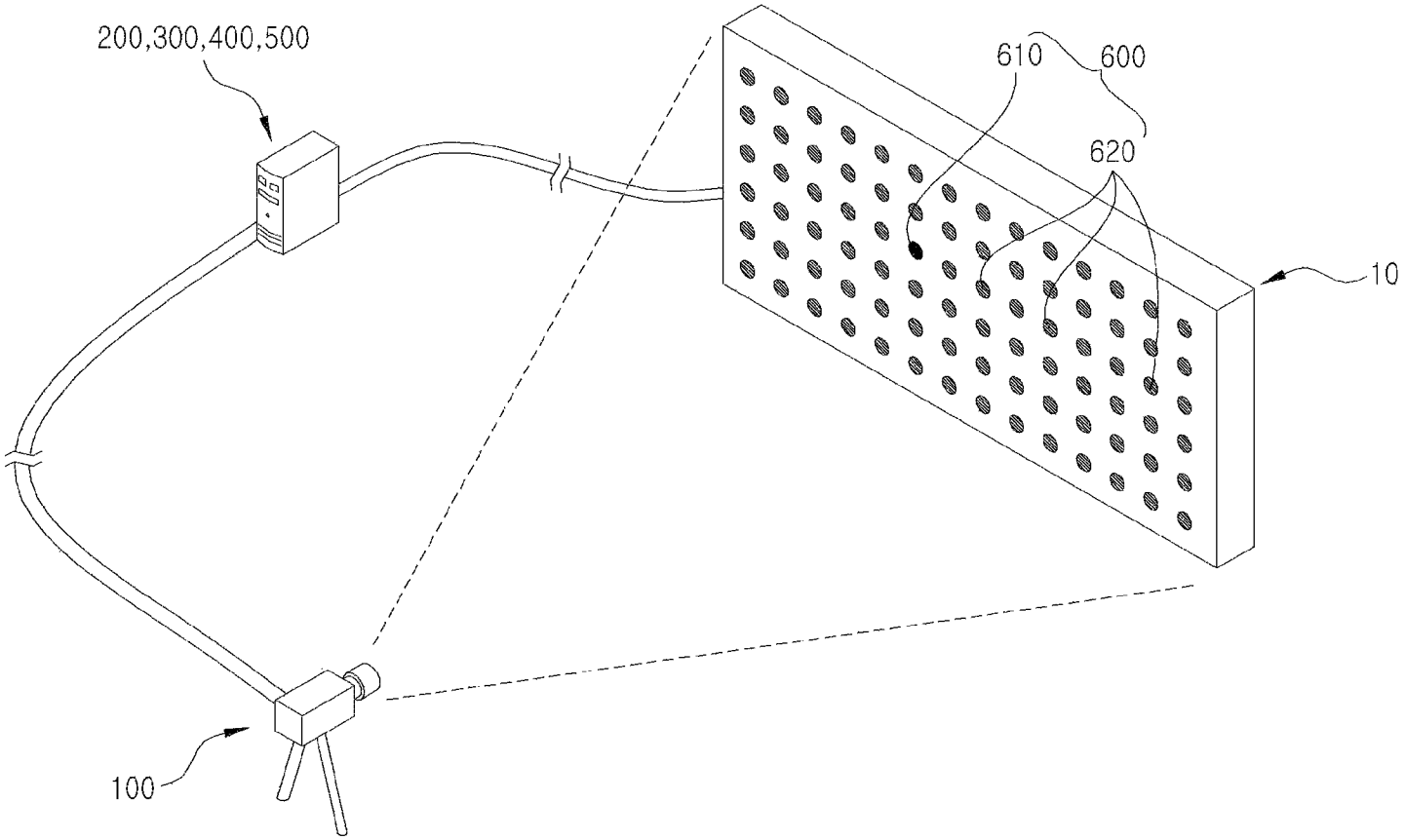
FIG. 3 is a schematic view showing an example in which luminance of an LED differs from that of the other LEDs in the system for controlling the smart LED display board according to the preferred embodiment of the present invention.

For instance, as shown in FIG. 3, if the luminance value of the first LED 610 is 7 and the average luminance value of the second LEDs 620 is 5, the comparison unit 300 creates the second input data including a compensation power value which reduces a power value supplied to the first LED 610 that emits light having a luminance value of 7 such that the first LED 610 emits light having a luminance value of 5 that is the same as that of the average luminance value of the second LEDs 620.

Figure 9:
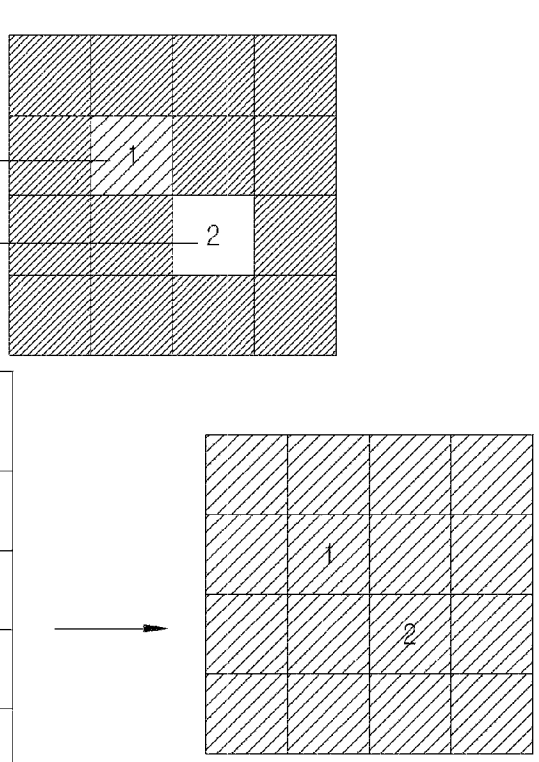
FIGS. 9 and 10 are schematic views showing an example of creating a luminance compensation value in the system for controlling the smart LED display board according to the present invention.
Figure 10:
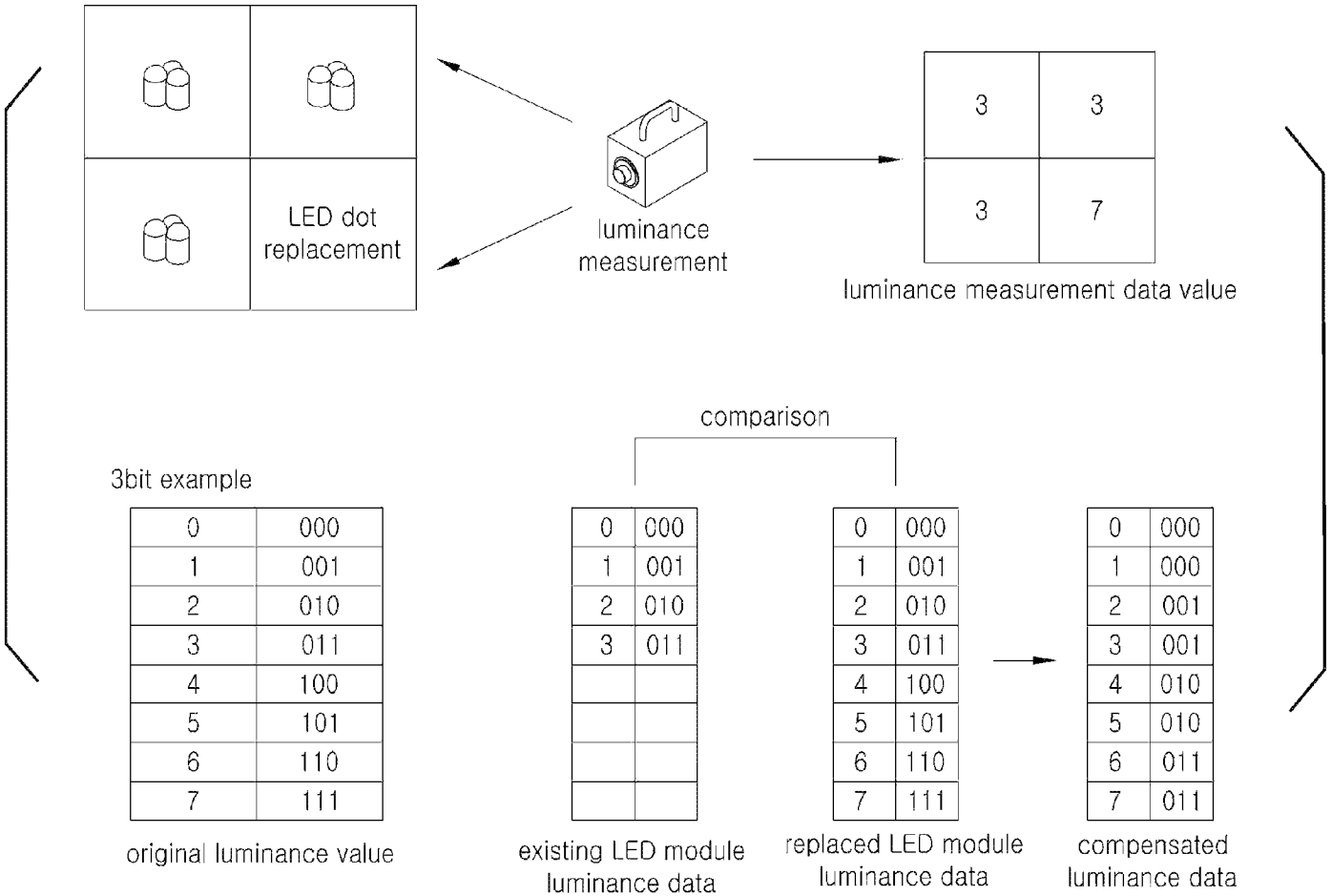

As shown in FIGS. 9 and 10, the comparison unit 300 compares luminance value tables (OldBrightTb and NewBrightTb) with each other, thus creating a luminance compensation value. Here, the comparison unit 300 creates luminance compensation values in levels from 0 to 255 and bit-calculates the created luminance compensation values and the input data together to compensate for the luminance.

Here, creation of the luminance compensation values is carried out in such a way as to compare luminance values of the OldBrightTb with luminance values of the NewBrightTb, search values adjacent to approximate values (integers), and determines the corresponding luminance compensation values.

The image data compensation unit 400 receives the first input data from the image data input unit 200 and the second input data from the comparison unit 300, and creates third input data in which the power value supplied when lighting on that is contained in the first input data transmitted to the first LED 610 is changed into the power value of the second input data.

The drive unit 500 receives the power value of the third input data transmitted from the image data compensation unit 400 and transmits the power value to the first LED 610.

As such, the luminance value of the first LED 610 corresponds to the average luminance value of the second LEDs 620 by the third input data transmitted to the first LED 610. Thereby, a spotting phenomenon, in which because of the high luminance value of the particular LED 600 of the display board 10 the surrounding LEDs 600 appear dim, can be prevented.

Furthermore, the system for controlling a smart LED display board capable of compensating for luminance of an LED according to the present invention having the above-mentioned construction may measure luminance values of LED dots and compensates for luminance of an LED dot which differs in luminance from an average of luminance values of the other LED dots.

Figure 4:
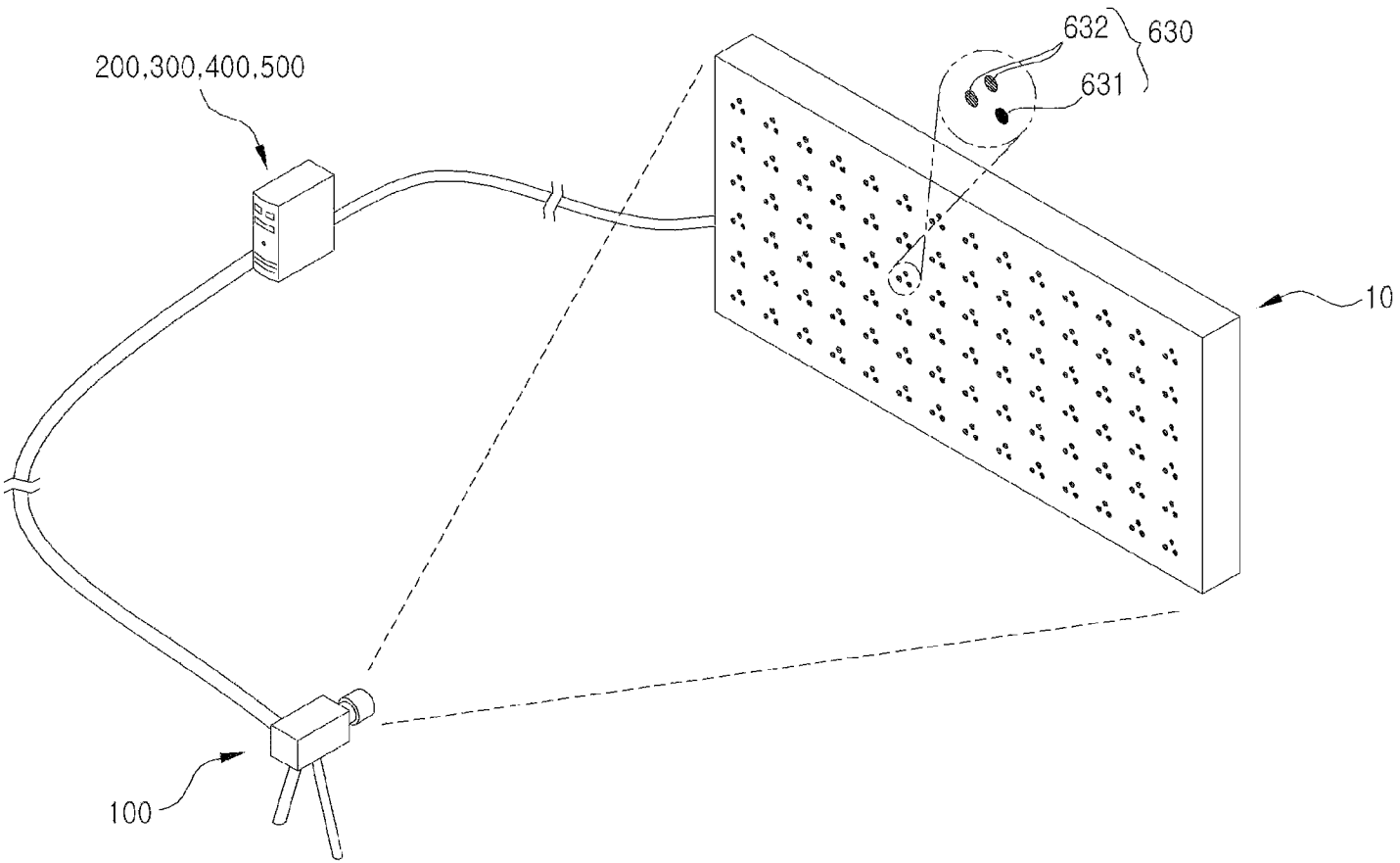
FIG. 4 is a schematic view showing an example in which luminance of a dot of an LED differs from that of dots of the other LEDs in the system for controlling the smart LED display board according to the preferred embodiment of the present invention.

Measuring luminance values of LED dots and compensating for luminance of a particular LED dot, an example of the system for controlling the smart LED display board will be described with reference to FIG. 4.

The luminance measurement unit 100 also measures luminance values of dots of the LEDs 600 and creates second luminance measurement data which is obtained by digitizing the measured luminance values of the LED dots 630.

Fourth input data about a lighting-on time, a lighting-off time, a power value supplied when lighting on and a luminance value when lighting on with regard to each LED dot 630 are also input to the image data input unit 200.

The comparison unit 300 receives the second luminance measurement data from the luminance measurement unit 100 and further creates, from the second luminance measurement data, fifth input data including a compensation power value which compensates for a luminance value of a first LED dot 631 so that the luminance value of the first LED dot 631 corresponds to an average value of the luminance values of second LED dots 632 other than the luminance value of the first LED dot 631 that is a predetermined value or more.

The image data compensation unit 400 receives the fourth input data from the image data input unit 200 and fifth input data from the comparison unit 300, and further creates sixth input data in which the power value supplied when lighting on that is contained in the fourth input data transmitted to the first LED dot 631 is changed into the power value of the fifth input data.

The drive unit 500 also receives the power value of the sixth input data transmitted from the image data compensation unit 400 and transmits the power value to the first LED dot 631.

As such, the luminance value of the first LED dot 631 corresponds to the average luminance value of the second LED dot 632 by the sixth input data transmitted to the first LED dot 631. Thereby, a spotting phenomenon in which because of the high luminance value of the particular LED dot 630 of the display board 10 the surrounding LED dots 630 appear dim can be prevented.

Furthermore, in the LEDs 600 formed of groups of RGB dots, the luminance thereof can be compensated for in unit of an LED dot 630 which corresponds to each of the RGB dots. Therefore, the present invention can more reliably match the luminance value of the particular LED 600 with the average of the luminance values of the other LEDs 600 other than the luminance value of the particular LED 600 that differs in luminance from that of the other LEDs 600.

Figure 6:
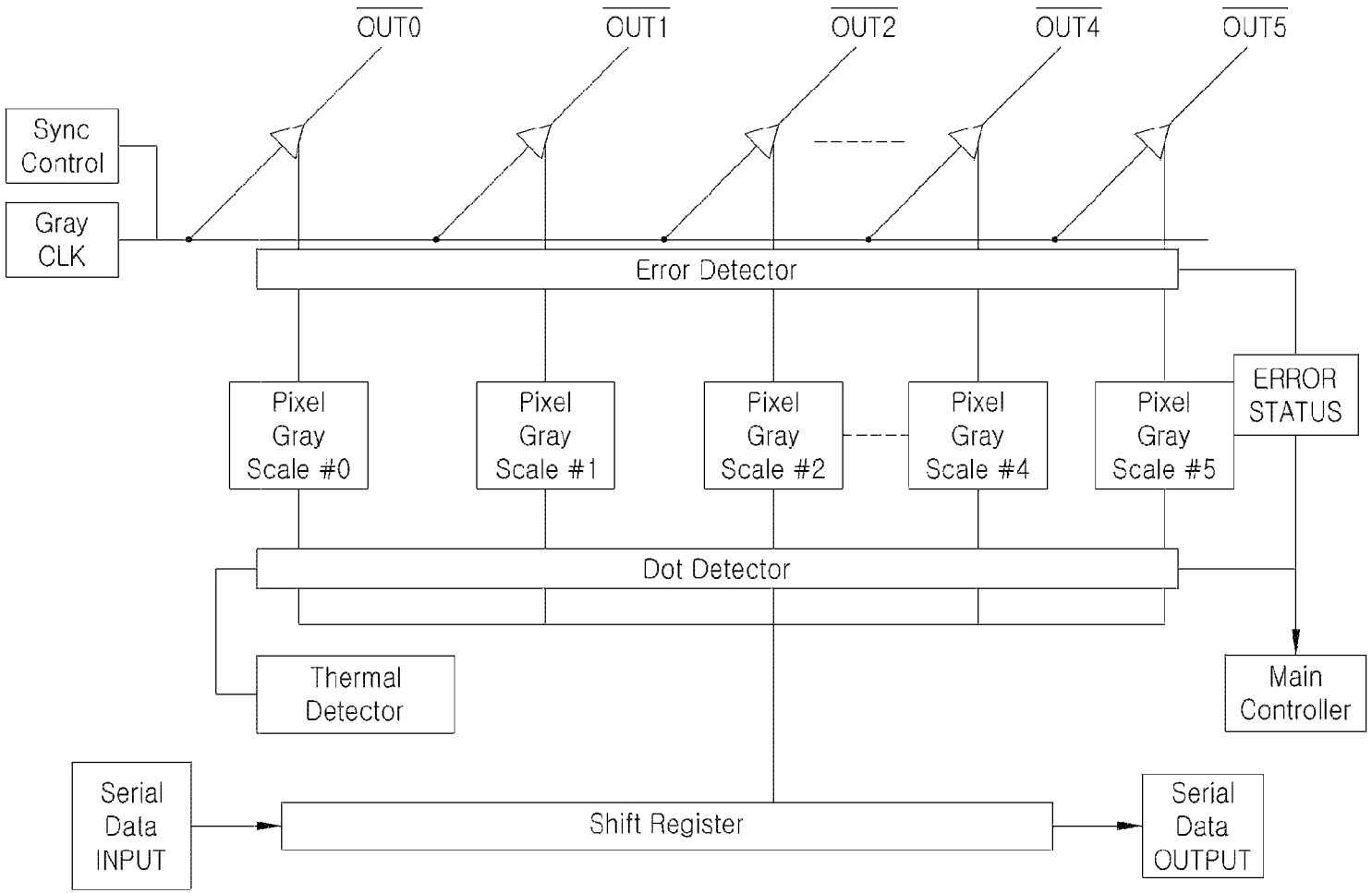
FIGS. 6 through 8 are block diagrams showing the system which further includes an error detector, a data output unit (serial data output: SDO), a shift unit and a constant current unit according to the present invention.
Figure 7:
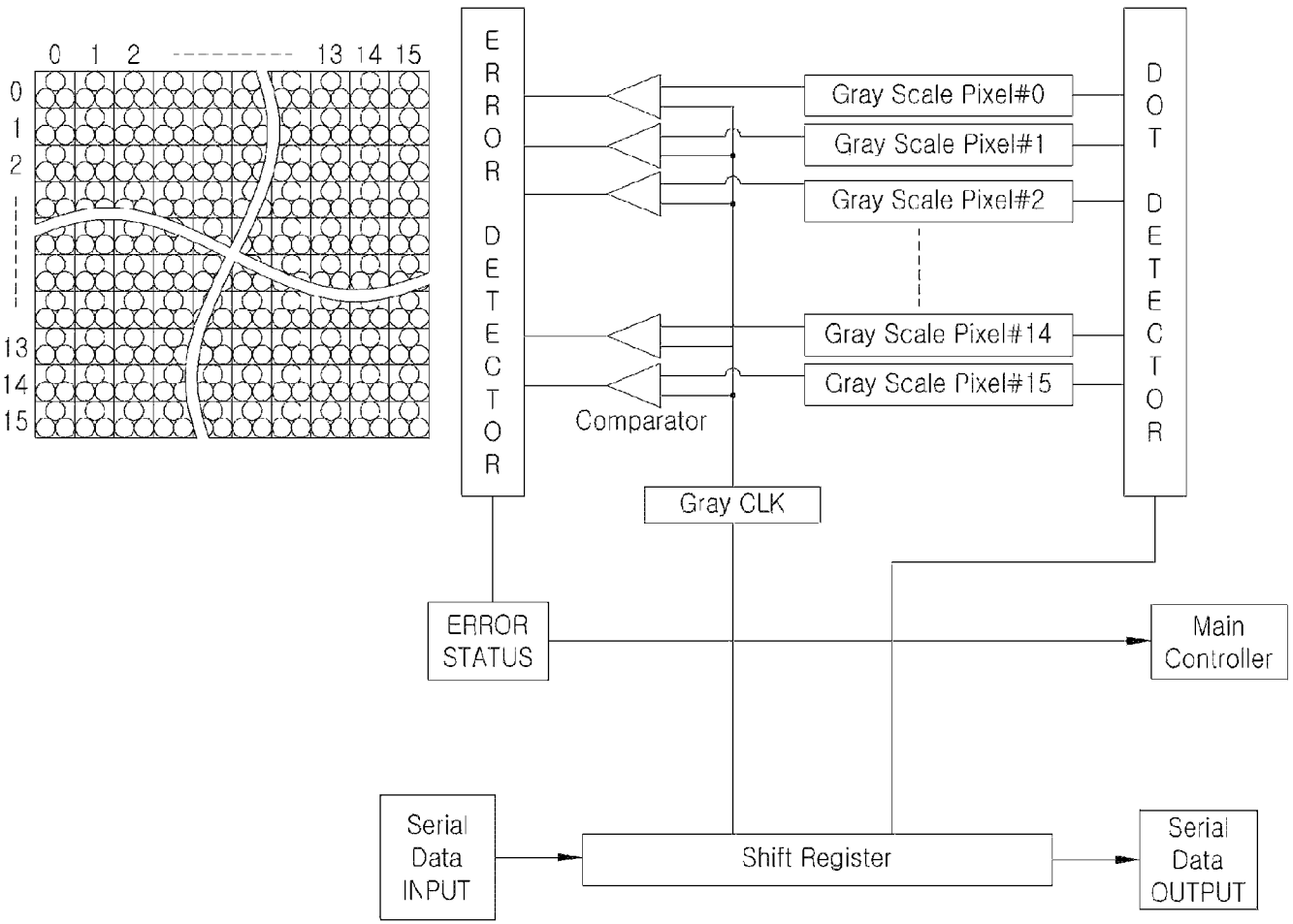
Figure 8:
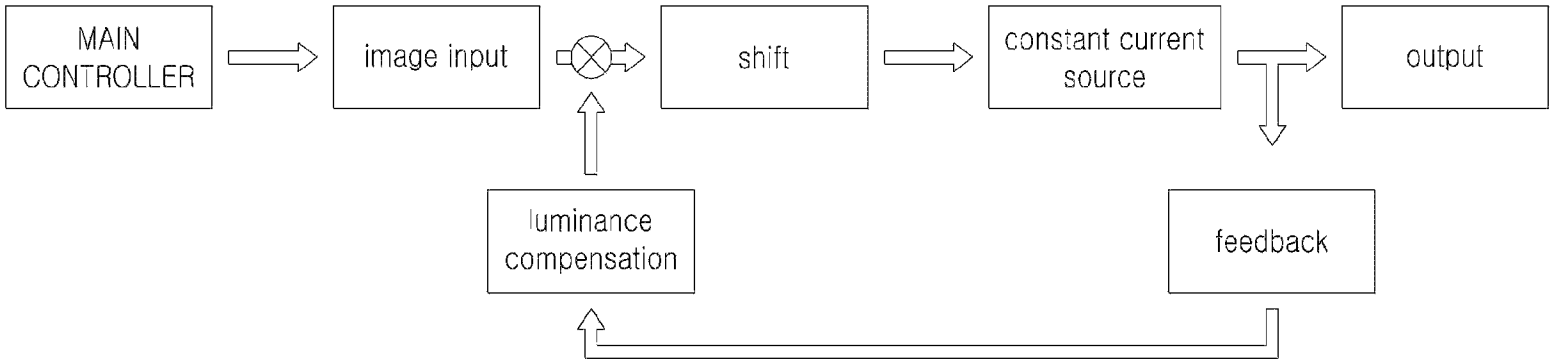

As shown in FIGS. 6 through 8, the system for controlling the smart LED display board capable of compensating for luminance of an LED according to the present invention further includes an error detector, a data output unit (serial data output: SDO), a shift unit and a constant current unit.

Figure 11:
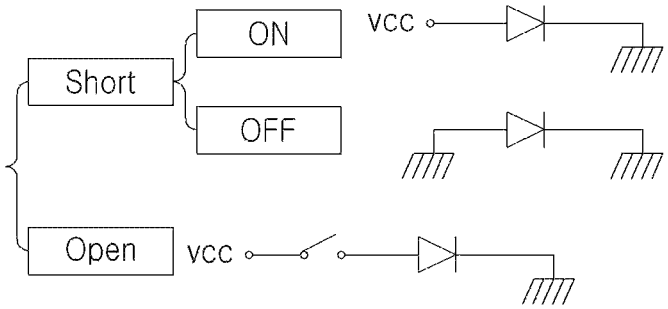
FIG. 11 is a schematic view showing a circuit of outputting error data in the system for controlling the smart LED display board according to the present invention.

As shown in FIG. 11, the error detector transmits an error signal, generated when disconnection or short-circuit of an LED dot circuit is caused, to a flag register and outputs error data.

The error detector is a technique which detects conditions of an LED module in an open-short circuit. Gray scale compensation is possible only when an input side of the circuit is connected to a VCC or GND, but the gray scale compensation is impossible when in an open state.

The data output unit transmits input shift image data as input data of a sequent LED module. When an error is detected and an error flag of the register is set, the data output unit outputs an error message. When an error occurs, the data output unit outputs error data through an output pin of a final module output terminal.

Controlling both shift and timing, the shift unit transmits image data that is compensated for by combining serial image data with a gray compensation value to an output driver. The shift unit treats error data in such a way as to send an error transmitted from the error detector of the output terminal as output data. The gray compensation value may be the above-stated compensation data or separate data.

The constant current unit receives data converted by the shift unit and generates constant current based on the received converted data. Such constant current generated from the constant current unit is transmitted to the drive unit, thus letting the LED dot emit light.

Hereinafter, a method for controlling a smart LED display board capable of compensating for luminance of an LED according to a preferred embodiment of the present invention will be explained with reference to FIG. 5. A luminance measurement unit 100, an image data input unit 200, a comparison unit 300, an image data compensation unit 400 and a drive unit 500 which will be explained in the following description of the method for controlling the smart LED display board are the same as the luminance measurement unit 100, the image data input unit 200, the comparison unit 300, the image data compensation unit 400 and the drive unit 500 of the system for controlling the smart LED display board. Therefore, further explanation of them will be omitted.

Figure 5:
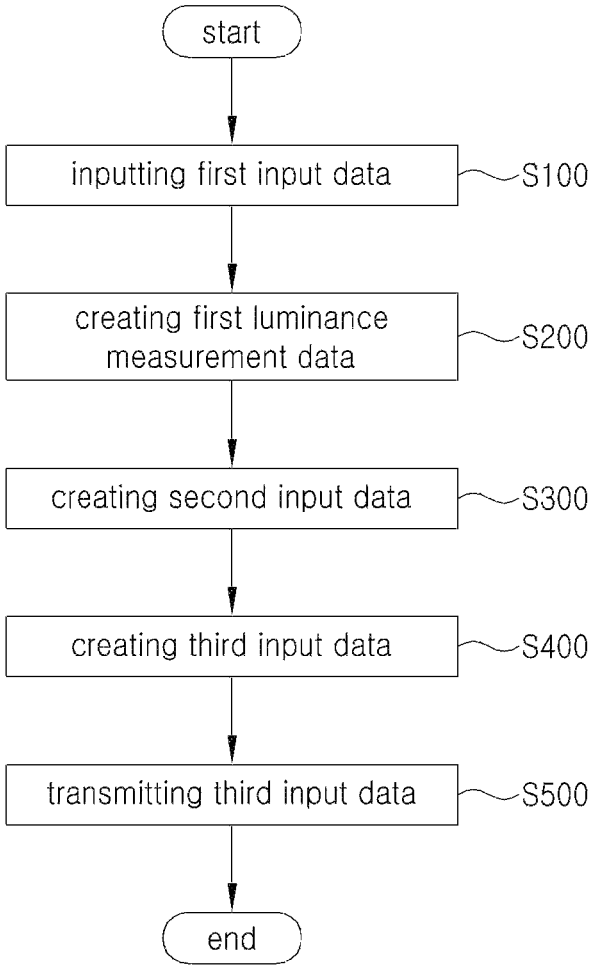
FIG. 5 is a flowchart showing a method for controlling a smart LED display board capable of compensating for luminance of an LED according to a preferred embodiment of the present invention.

As shown in FIG. 5, the method for controlling the smart LED display board according to the present invention includes a first-input-data input step S100, a first-luminance-measurement-data creating step S200, a second-input-data creating step S300, a third-input-data creating step S400 and a third-input-data transmitting step S500.

At the first-input-data input step S100, the image data input unit 200 receives first input data about a lighting-on time, a lighting-off time, a power value supplied when lighting on and a luminance value when lighting on with regard to each LED 600 of the display board 10.

At the first-luminance-measurement-data creating step S200, the luminance measurement unit 100 measures luminance of each LED 600 of the display board 10 and digitizes the measured luminance values of the LEDs 600, thus creating first luminance measurement data. As shown in FIG. 2, measuring luminance values of the LEDs 600, the luminance measurement unit 100 is disposed at a position spaced apart from the display board 10 by a predetermined distance.

At the second-input-data creating step S300, the comparison unit 300 receives the first luminance measurement data from the luminance measurement unit 100 and creates, from the first luminance measurement data, second input data including a compensation power value which compensates for a luminance value of the first LED 610 so that the luminance value of the first LED 610 corresponds to an average value of the luminance values of second LEDs 620 other than the luminance value of the first LED 610 that is a predetermined value or more.

At the third-input-data creating step S400, the image data compensation unit 400 receives the first input data from the image data input unit 200 and the second input data from the comparison unit 300, and creates third input data in which the power value supplied when lighting on that is transmitted to the first LED 610 and contained in the first input data is changed into the power value of the second input data.

At the third-input-data transmitting step S500, the drive unit 500 receives the power value of the third input data transmitted from the image data compensation unit 400 and transmits the power value to the first LED 610.

Furthermore, the above-stated method for controlling the smart LED display board according to the present invention may also measure luminance values of LED dots and compensates for luminance of an LED dot which differs in luminance from an average of luminance values of the other LED dots.

Measuring luminance values of LED dots and compensating for luminance of a particular LED dot, an example of the method for controlling the smart LED display board will be described below.

At the first-input-data input step S100, the image data input unit 200 also receives the fourth input data about a lighting-on time, a lighting-off time, a power value supplied when lighting on and a luminance value when lighting on with regard to each LED dot 630.

At the first-luminance-measurement-data creating step S200, the luminance measurement unit 100 also measures luminance values of dots of the LEDs 600 and creates second luminance measurement data which is obtained by digitizing the measured luminance values of the LED dots 630.

At the second-input-data creating step S300, the comparison unit 300 receives the second luminance measurement data from the luminance measurement unit 100 and further creates, from the second luminance measurement data, fifth input data including a compensation power value which compensates for a luminance value of a first LED dot 631 so that the luminance value of the first LED dot 631 corresponds to an average value of the luminance values of second LED dots 632 other than the luminance value of the first LED dot 631 that is a predetermined value or more.

At the third-input-data creating step S400, the image data compensation unit 400 receives the fourth input data from the image data input unit 200 and fifth input data from the comparison unit 300, and further creates sixth input data in which the power value supplied when lighting on that is transmitted to the first LED dot 631 and contained in the fourth input data is changed into the power value of the fifth input data.

At the third-input-data transmitting step S500, the drive unit 500 also receives the power value of the sixth input data transmitted from the image data compensation unit 400 and transmits the power value to the first LED dot 631

As described above, according to a system and method for controlling a smart display board capable of compensating for luminance of an LED according to the present invention, in a display board using LEDs, after an LED that has malfunctioned is individually replaced with a new one, the luminance of the replaced new LED can be individually compensated for so that it can correspond to the luminance of the surrounding existing LEDs of the display board.

Furthermore, in the system and method for controlling the smart display board according to the present invention, even if an LED dot malfunctions and is individually replaced with a new one, the luminance of the replaced new LED dot can be individually compensated for so that it can correspond to the luminance of the surrounding existing LED dots.

Although the preferred embodiment of the present invention has been disclosed, those skilled in the art will appreciate that various modifications, additions and substitutions are possible, without departing from the scope and spirit of the invention as disclosed in the accompanying claims. Therefore, it should be understood that the preferred embodiment is only for illustrative purposes and does not limit the bounds of the present invention. For instance, components which have been illustrated as being integrated with each other may be implemented in a separate structure, and components which have been illustrated as being separately provided may be provided in an integrated structure.

What is claimed is:

1. A system for controlling a smart LED display board capable of compensating for luminance of an LED, comprising:

a luminance measurement unit measuring luminance of each of LEDs of the display board and creating a first luminance measurement data obtained by digitizing the measured luminance of each of the LEDs;

an image data input unit implemented by a processor, the image data input unit receives a first input data about a lighting-on time, a lighting-off time, a power value supplied when lighting on and a luminance value when lighting on with regard to each of the LEDs;

a comparison unit implemented by a processor, the comparison unit receives the first luminance measurement data from the luminance measuring unit, selects, based on the first luminance measurement data, at least one first LED having a luminance value greater than a preset reference luminance value among the LEDs that have been digitized in luminance values, and creates a compensation power value compensating for the luminance value of the selected first LED so that the luminance value of the first LED corresponds to an average value of luminance values of second LEDs that are remaining LEDs other than the first LED;

an image data compensation unit implemented by a processor, the image data compensation unit receives the first input data from the image data input unit and the compensation power value from the comparison unit, and creates second input data in which a power value to be supplied when lighting on that is contained in the first input data transmitted to the first LED is changed into the compensation power value; and a drive unit implemented by a processor, the drive unit receives the second input data from the image data compensation unit, transmits the second input data to the first LED, the luminance measurement unit measuring luminance of each of LED dots which are light emitting units included in each of the LEDs, and further creates second luminance measurement data obtained by digitizing the measured luminance of each of the LED dots, wherein the image data input unit further receives a third input data about a lighting-on time, a lighting-off time, a power value supplied when lighting on and a luminance value when lighting on with regard to each of the LED dots, the comparison unit receives the second luminance measurement data from the luminance measuring unit and selecting, from the second luminance measurement data, at least one first LED dot having a luminance value greater than a preset reference luminance value among the LED dots that have been digitized in luminance values, and further creates a compensation power value compensating for the luminance value of the selected first LED dot so that the luminance value of the first LED dot corresponds to an average value of luminance values of second LED dots that are remaining LED dots other than the first LED dot, the image data compensation unit receives the third input data from the image data input unit, receives the compensation power value from the comparison unit, and further creates fourth input data in which a power value supplied when lighting on that is contained in the third input data transmitted to the first LED dot is changed into the compensation power value, and the drive unit receives the fourth input data transmitted from the image data compensation unit and further transmitting the fourth input data to the first LED dot.

2. A method for controlling a smart LED display board capable of compensating for luminance of an LED, comprising:

receiving, by an image data input unit implemented by a processor, a first input data about a lighting-on time, a lighting-off time, a power value supplied when lighting on and a luminance value when lighting on with regard to each of LEDs of the display board;

measuring, by a luminance measurement unit, luminance of each of LEDs of the display board and creating first luminance measurement data obtained by digitizing the measured luminance of each of the LEDs;

receiving, by a comparison unit implemented by a processor, the first luminance measurement data from the luminance measuring unit and selecting, based on the first luminance measurement data, at least one first LED having a luminance value greater than a preset reference luminance value among the LEDs that have been digitized in luminance values, and creating a compensation power value compensating for the luminance value of the selected first LED so that the luminance value of the first LED corresponds to an average value of luminance values of second LEDs that are remaining LEDs other than the first LED;

receiving, by an image data compensation unit implemented by a processor, the first input data from the image data input unit and receiving the compensation power value from the comparison unit, and creating a second input data in which a power value to be supplied when lighting on that is contained in the first input data transmitted to the first LED is changed into the compensation power value; and receiving, by a drive unit implemented by a processor, the second input data from the image data compensation unit and transmitting the second input data to the first LED, wherein a third input data is further received by the image data input unit when the first input data is received, the third input data includes a lighting-on time, a lighting-off time, a power value supplied when lighting on and a luminance value when lighting on with regard to each of LED dots which are light emitting units included in each of the LEDs, measuring the luminance of each of the LEDs comprises measuring, by the luminance measurement unit, luminance of each of the LED dots and creating a second luminance measurement data obtained by digitizing the measured luminance of each of the LED dots, receiving the first luminance measurement data comprises receiving, by the comparison unit, the second luminance measurement data from the luminance measuring unit and selecting, from the second luminance measurement data, at least one first LED dot having a luminance value greater than a preset reference luminance value among the LED dots that have been digitized in luminance values, and creating a compensation power value compensating for the luminance value of the selected first LED dot so that the luminance value of the first LED dot corresponds to an average value of luminance values of second LED dots that are remaining LED dots other than the first LED dot, receiving the first input data comprises receiving, by the image data compensation unit, the third input data from the image data input unit and receiving the compensation power value from the comparison unit, and creating fourth input data in which a power value supplied when lighting on that is contained in the third input data transmitted to the first LED dot is changed into the compensation power value, and receiving the second input data comprises receiving, by the drive unit, the fourth input data transmitted from the image data compensation unit and transmitting the fourth input data to the first LED dot.

* * * * *